United States Patent [19]

Liebermann

[11] Patent Number: 4,491,250

[45] Date of Patent: Jan. 1, 1985

[54] PRESSURIZED DISPENSING POUCH

[75] Inventor: Benno E. Liebermann, Louisville, Ky.

[73] Assignee: Grow Group, Inc., New York, N.Y.

[21] Appl. No.: 401,119

[22] Filed: Jul. 23, 1982

[51] Int. Cl.[3] ..... B65D 83/14

[52] U.S. Cl. ..... 222/386.5; 222/399

[58] Field of Search ..... 222/95, 96, 386.5, 394, 222/399, 190; 239/322, 323; 169/33, 85

[56] References Cited

U.S. PATENT DOCUMENTS

| | | | |
|---|---|---|---|
| 2,932,385 | 4/1960 | Bollmeier et al. . | |
| 3,023,750 | 3/1962 | Baron . | |
| 3,053,422 | 9/1962 | Tenison et al. . | |
| 3,178,075 | 4/1965 | Riedl et al. . | |
| 3,240,394 | 3/1966 | Modderno | 222/95 |
| 3,342,324 | 9/1967 | Piazze . | |
| 3,430,731 | 3/1969 | Satzinger et al. . | |
| 3,478,871 | 11/1969 | Sager . | |
| 3,541,581 | 11/1970 | Monson . | |
| 3,608,709 | 9/1971 | Pike . | |
| 3,718,236 | 2/1973 | Reyner et al. . | |
| 4,360,131 | 11/1982 | Reyner | 222/386.5 |
| 4,373,341 | 2/1983 | Mahaffy et al. | 222/394 |
| 4,376,500 | 3/1983 | Banks et al. | 222/399 |

FOREIGN PATENT DOCUMENTS

| | | |
|---|---|---|
| 2155846 | 5/1972 | Fed. Rep. of Germany . |
| 0033377 | 12/1981 | European Pat. Off. . |
| 765082 | 1/1957 | United Kingdom . |

*Primary Examiner*—H. Grant Skaggs

*Attorney, Agent, or Firm*—Kenyon & Kenyon

[57] ABSTRACT

A product dispensing system is disclosed comprised of a gas generating piston action pouch formed in one embodiment from an elongated flexible plastic tubular member having one end portion folded inwardly on the other portion to integrally form an inner tube within an outer tube and outwardly slideable relative thereto. Both ends of the tubular member are sealed thus providing a sealed interstitial cavity between the two portions and a product receptacle within the folded portion. Successive gas generating components are located in the cavity and operatively connected between the portions to generate successive additional quantities of gas as the inner tube moves outwardly from the outer tube to dispense product from the receptacle under relatively constant pressure or any variation or increase or decrease of pressure if shelf life performance dictates specific pressure variances.

The pouch itself can be a self-contained product dispenser or can be utilized as an insert component in another container.

11 Claims, 11 Drawing Figures

PRESSURIZED DISPENSING POUCH

FIELD OF THE INVENTION

This invention relates to pressurized dispensers of the type that generate gaseous dispensing pressure within the container in successive amounts as the product is being dispensed and in which the gas medium does not come into contact with the product, and further in which the gas medium is not a hydrocarbon or a fluorocarbon and is confined so that it never reaches the atmosphere.

BACKGROUND OF THE INVENTION

In recent years various efforts have been exerted to supplant conventional aerosol-type dispensers, which used hydrocarbons such as isobutane, or fluorocarbons such as freon, with other propellant means. Such efforts were generally compelled by several factors, the substantial increase in petroleum prices, by scientists' concern in vented fluorocarbons destroying or seriously diminishing the protective ozone layer in the atmosphere which resulted in prohibitive federal and state legislations, and by the inherent explosive and flammable properties of conventional aerosols.

The developmental work took several directions, from the use of mechanical components such as springs, pistons and spring loaded valves; the use of compressed air and gaseous media other than hydrocarbons and fluorocarbons; as well as various types of packaged flexible and expandable inserts with self-contained gas generating components. The latter have shown greater promise both from economic and safety considerations as well as the simplicity and reliability of performance. The embodiments of the present invention disclosed hereinafter involve novel, useful and non-obvious improvements in such packaged inserts, and/or sequential pressure generating dispensing containers.

BRIEF SUMMARY OF THE INVENTION

Briefly stated, the present invention provides a piston-action pouch for insertion into a product dispenser, or can be used as the product dispenser itself, and comprises an elongated tubular member sealed at a first end and is folded or molded inwardly into itself so that the second end, which is also sealed, lies within the outer portion of the tubular member but at an inwardly spaced position from the first end. This configuration provides a fluid tight interstitial volume having an annular space between the adjacent outer and inner walls of the tubular member, as well as an interconnecting interior well space between the first and second ends. It also provides a product receiving volume or receptacle centrally of the folded or molded portion.

Pressure generating means disposed within said interstitial volume is adapted to generate successive amounts of propellant gas in said interstitial volume to urge the folded portion of the tubular member axially outwardly from the outer portion to reduce the volume of the product receptacle and thereby expel product therefrom.

The pressure generating means is a two-component system, e.g., citric acid and sodium bicarbonate, either of which may be initially in the well space, the other in aliquot amounts being distributed in pockets disposed axially along the annular interstitial space so as to be sequentially opened as the folded portion is urged outwardly from the outer portion.

The pouch can constitute the dispensing apparatus itself, with a suitable cap and dispensing valve covering the product receptacle, or the pouch can be inserted into a dispenser container, as will appear in the following detailed description.

The action of the piston pouch therefore provides uniform and positive reliable action in opening the pockets which ensures against premature opening of a pocket, or out of sequence opening of the pockets.

DETAILED DESCRIPTION

Figure 1:
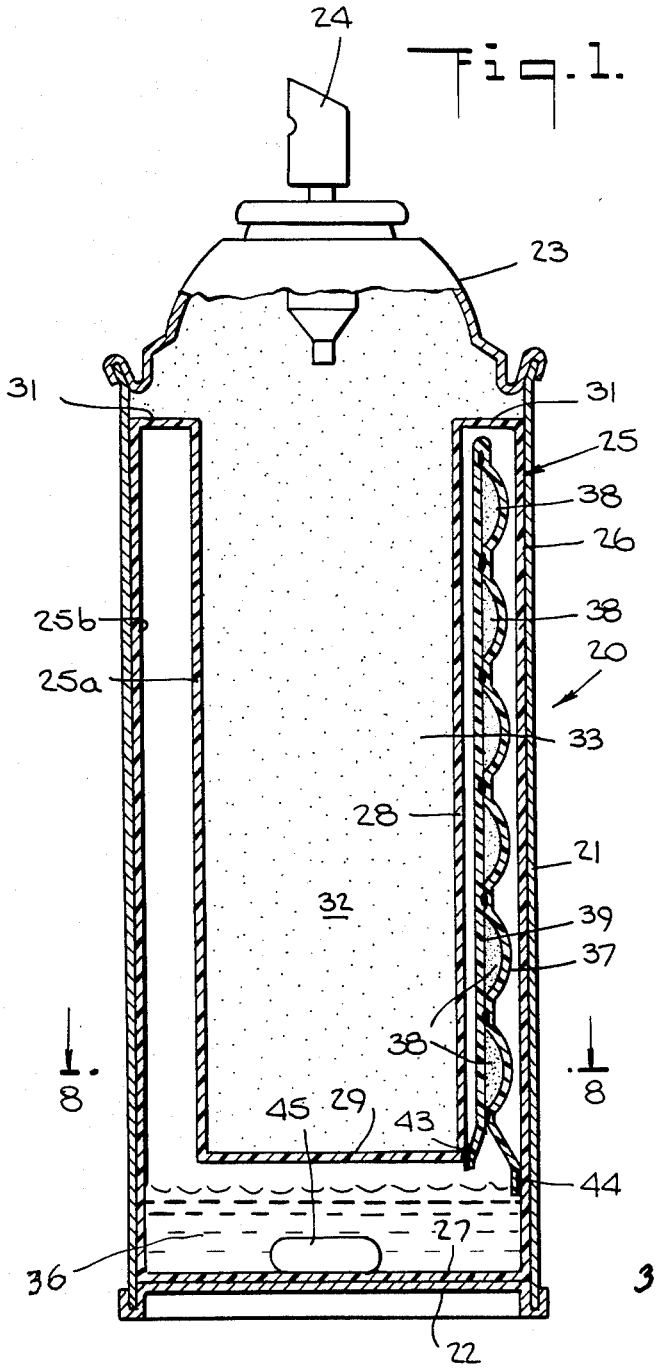
FIG. 1 is an elevation in section of one embodiment of the invention.

Referring now to the drawings, in which like parts are designated by the same or similar reference numerals for clarity, where possible, and in particular FIG. 1, one embodiment is shown comprising a container designated generally by reference numeral 20 which may be of any conventional construction such as that of the standard aerosol-type container having a metallic cylindrical body 21, enclosed bottom 22, and top or closure member 23 carrying manually actuatable spray valve 24.

Figure 4:
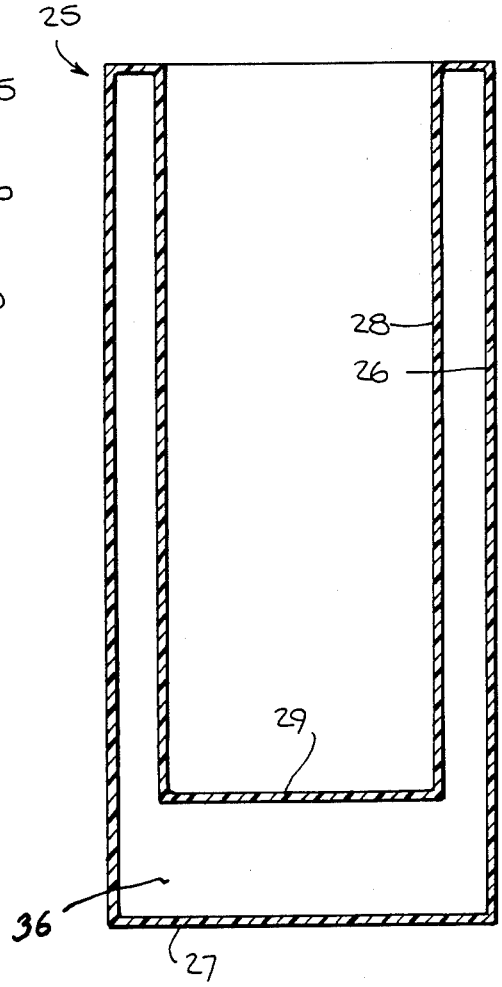
FIG. 4 is an elevation in section of the tubular member folded inwardly upon itself.

Disposed within container 20 is a piston pouch 25 comprised of elongated tubular outer wall portion 26 sealed closed at its lower or first end 27 as viewed in the Figures and inwardly folded inner tubular wall portion 28 disposed to lie within outer wall 26 as shown and having a sealed second end 29 (see also FIG. 4). This arrangement provides, in effect, a cylinder constituted by outer wall portion 26 and an operative piston constituted by inner wall portion 28 movable within said cylinder.

Figure 10:
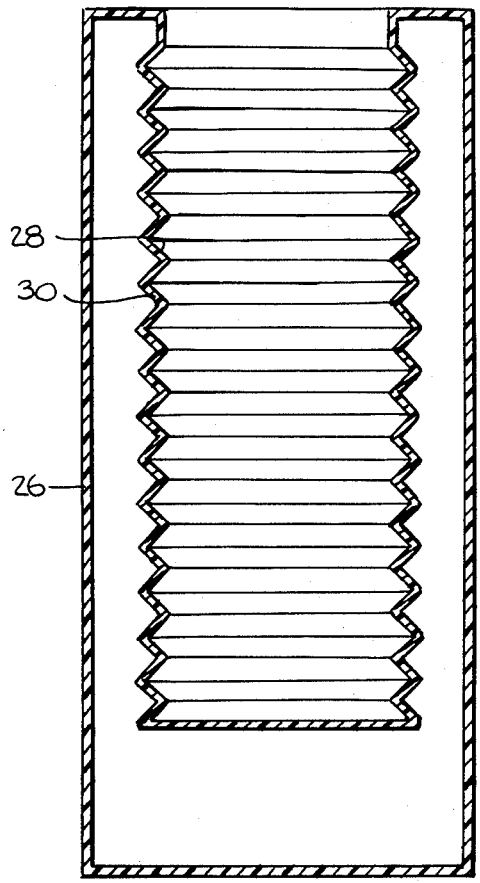
FIG. 10 is an elevation section similar to FIG. 4, showing another embodiment wherein the inwardly folded portion is pleated.

Pouch 25 may be constructed, formed, molded or extruded of suitable gauge fluid impermeable, flexible mono-layer plastic, or laminated plastic film or other suitable material composition in which the contacting sides 25*a*, 25*b* of the inner and outer wall portions 26, 28 respectively may be of different non-homogenous physically repellent plastics, or the outer wall 26 may be of substantially thicker gauge essentially self-supporting plastic material whereas inner wall 28 can be thinner, more flexible plastic and even with a smaller diameter and optionally also with longitudinally spaced circumferential pleats 30 (see FIG. 10). It is even contemplated to be within the scope of the invention that outer wall 26 and inner wall 28 may be independently fabricated and then joined at their respective upper ends 31 as viewed in the Figures.

Pouch 25 thus has a product receptacle portion 32 closed at bottom seal 29 and open at upper end 31 to receive product 33 which may be any dispensible material such as liquids of various viscosities, granular solid, grease, paste or the like, or a combination of one or more of such materials.

Figure 2:
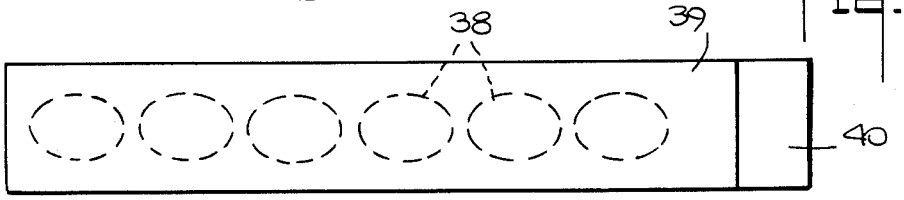
FIG. 2 is a plan view of one embodiment of the pressure generating means, i.e., an insert strip containing the pockets and the cover strip.
Figure 3:
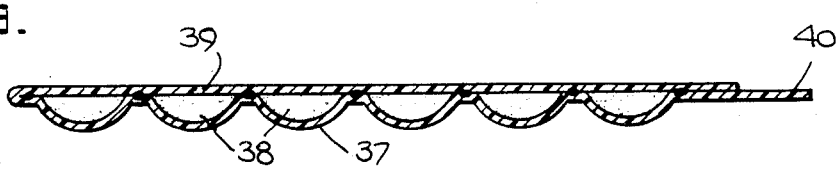
FIG. 3 is a side elevation in section taken along lines 2—2 of FIG. 2.
Figure 5:
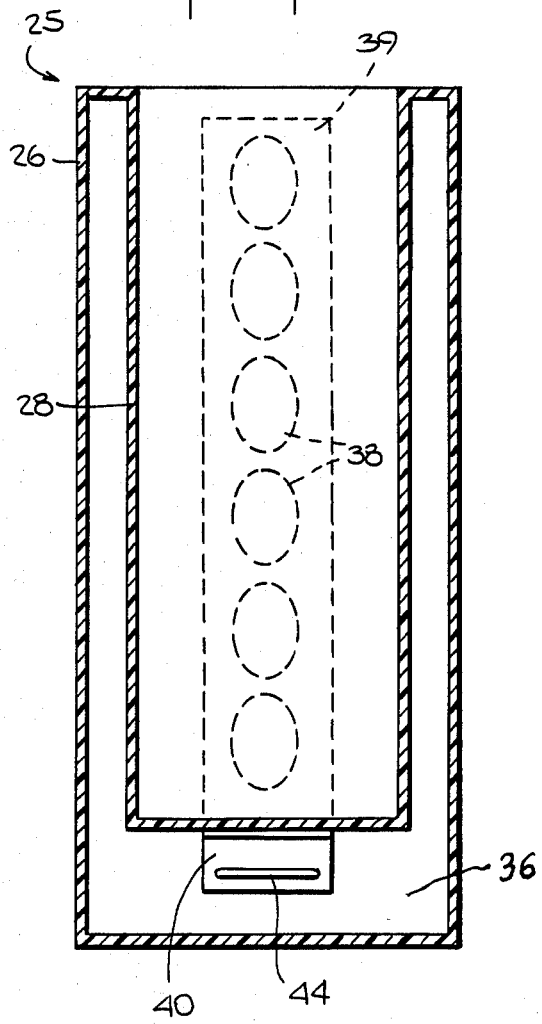
FIG. 5 is the same as FIG. 4 with the strip of FIGS. 2 and 3 in place.

Inner and outer walls 26, 28 define an interior interstitial cavity 34 between them having an annular portion 35 and a lower well portion 36. Disposed axially or longitudinally in the annulus 35 (see FIGS. 1 and 5) is elongated strip 37 carrying a plurality of longitudinally spaced recesses, pockets or cavities 38, which are closed by closure strip 39, the latter being generally coextensive in dimensions with strip 37 except that strip 37 has an exposed extension portion 40 (see also FIGS. 2 and 3). Closure strip 39 is releasably adhered to elongated strip 37 at least at points 41 (see FIG. 3) to close pockets 38 in a fluid tight manner.

Figure 8:
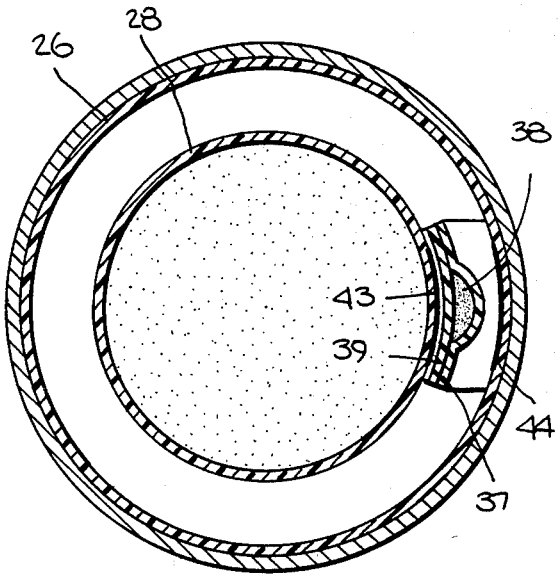
FIG. 8 is a sectional view taken along lines 8—8 of FIG. 1.

End portion 42 of closure strip 39 and extension 40 of elongated strip 37 are permanently adhered to inner wall 28 and outer wall 26, respectively by respective seals 43, 44 as shown in FIGS. 1 and 8.

Pockets 38 are adapted to carry aliquots of a first component, e.g., citric acid solution, of a two component gas generating system (citric acid/sodium bicarbonate) and interstitial well 36 is adapted to carry the full reactive stoichiometric quantity of the second component, e.g., sodium bicarbonate powder or solution.

Figure 11:
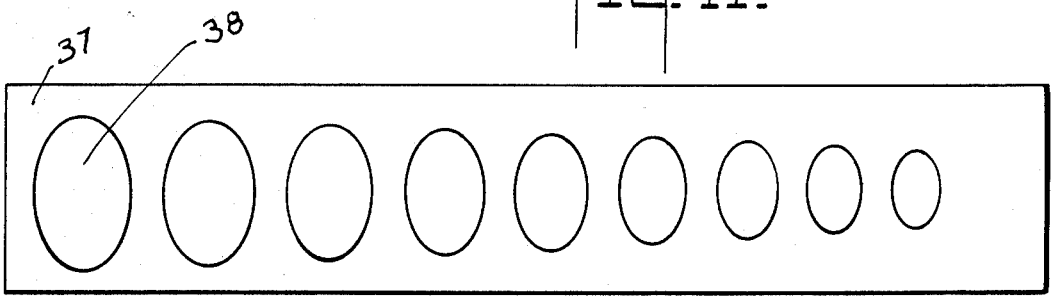
FIG. 11 is a plan view of another embodiment of the pocket containing strip having pockets of varying volumes.

Strip 37 may also be constructed as shown in FIG. 11 with pockets 38 of varying volumes in progression in order to effect a progressive increase in generated pressure during the progressive dispensing sequence of the dispensible product.

Starting capsule 45 is also disposed in well 36 and carries a starting aliquot of said first component to initiate the generation of pressure at or after assembly of pouch 25. Such capsule 45 may be fabricated of degradable material that decomposes in contact with the sodium bicarbonate solution or it may be physically frangible to discharge its contents into admixture with the component in well 36. Both such types of capsules, as well as other equivalent starting means, are well-known in the art.

Operation of the FIG. 1 embodiment after assembly is as follows. At or after assembly the starting capsule is activated to initiate generation of $C0_2$ gas which soon reaches an equilibrium pressure due to incompressibility of product 33. Upon manual actuation of valve 24, product is dispensed which according to Le Chatelier's principle permits additional gas to be generated. During further gas generation, bottom 29 of inner wall portion 28 moves axially outwardly, or upwardly as viewed in FIG. 1 relative to outer wall portion 26, as a piston moves in a cylinder. Back pressure from undispensed product 33 limits such relative movement in a controlled manner. Likewise cover strip 39 sealed to inner wall 28 is gradually peeled away in a longitudinal direction from elongated strip 37 to uncover in a controlled sequence successive pockets 38 to deliver successive aliquots of said first component into contact with said second component in well 36 to generate more $C0_2$ gas and thereby maintain a relatively constant dispensing pressure in said container 20. With such an arrangement, as can be seen, the pockets cannot be opened out of sequence or prematurely, so that maximum efficiency and reliability is guaranteed.

Figure 6:
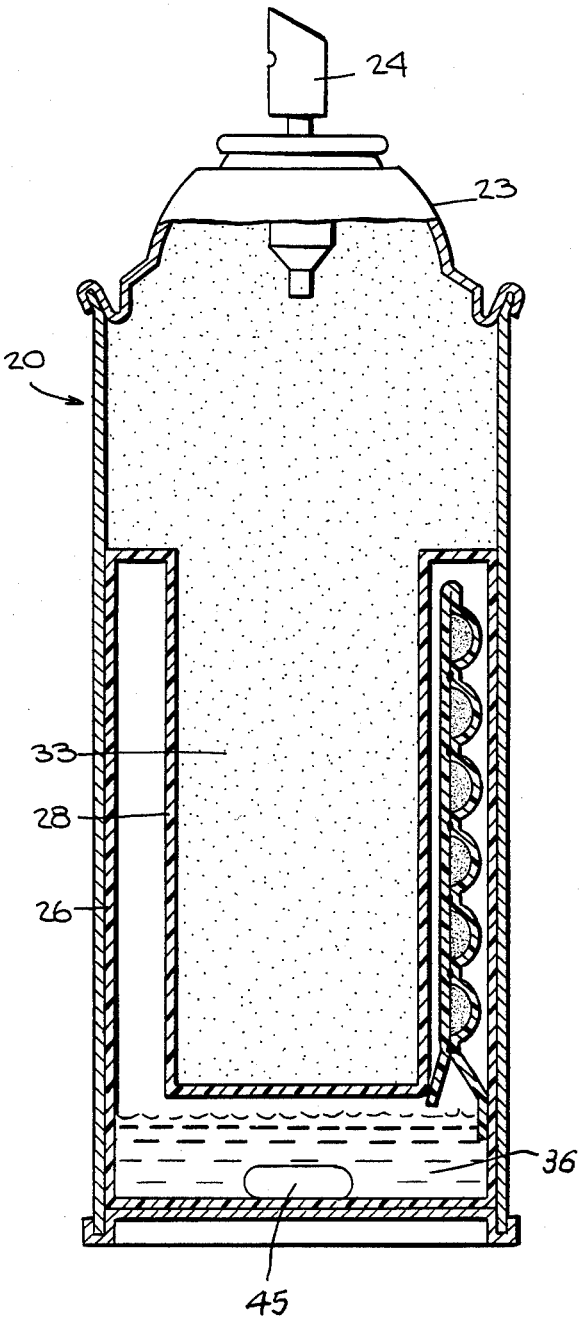
FIG. 6 is an elevation section of a separate dispensing container with the piston pouch in place.
Figure 7:
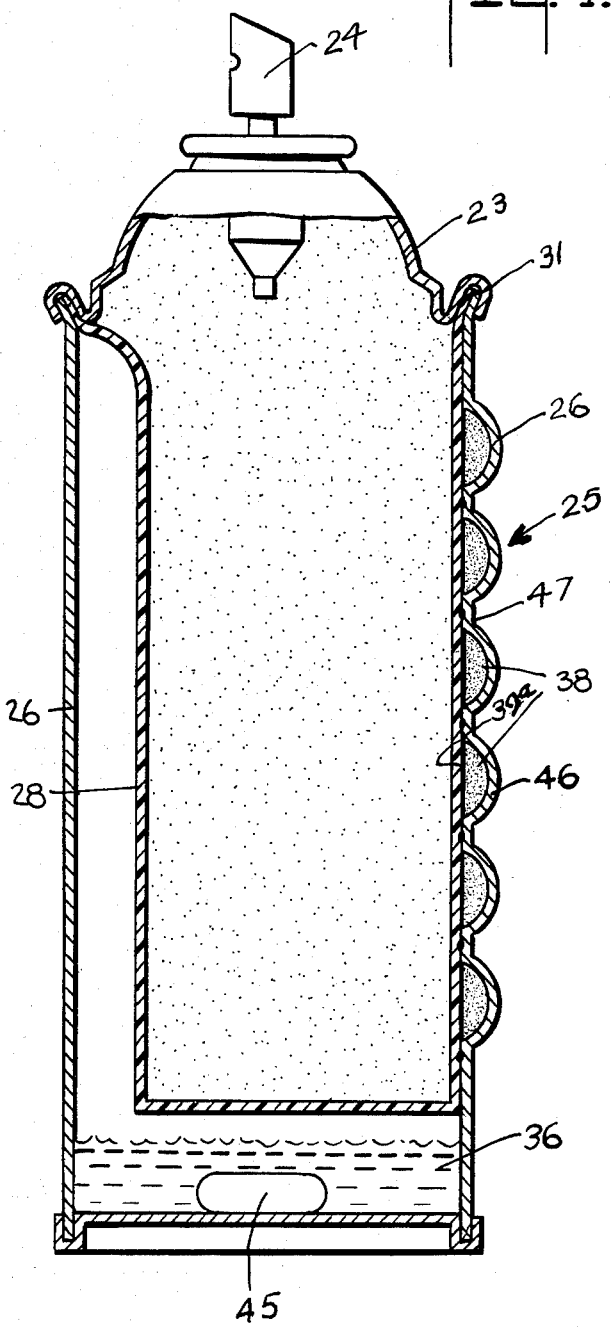
FIG. 7 is an elevation section of another embodiment of the pouch with the pockets formed in one position of the outer wall.
Figure 9:
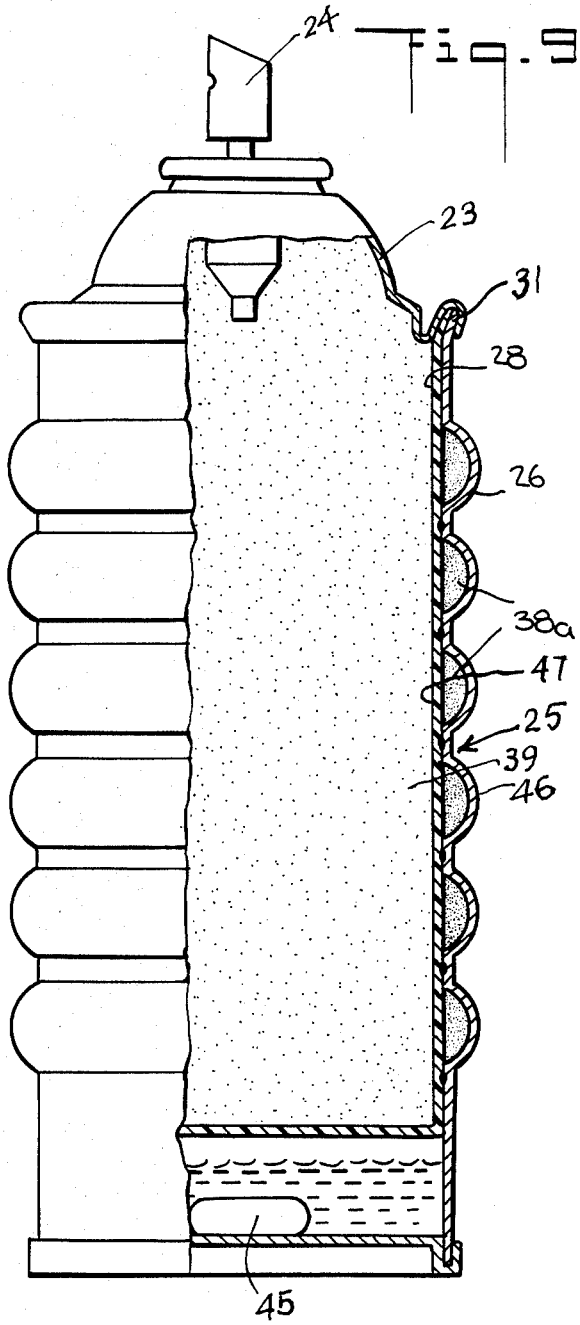
FIG. 9 is an elevation section of another embodiment of the pouch with annular pockets formed in the outer wall.

Alternate optional embodiments are contemplated to be within the scope of the present invention. Pouch 25 may be of shorter relative length than container 20, if desired, as shown in FIG. 6. Pouch 25 of FIG. 1 itself can constitute the dispenser (see also FIGS. 7 and 9) by assembling cap 23 and dispensing valve 24 at upper end 31 of pouch 25. Pockets 38 may be integrally formed in one portion 46 of outer wall 26 and the adjacent portion 47 of inner wall 28 may be used as the releasable cover **39*a* (see FIG. 7). As shown in FIG. 9, annular cavities 38*a* may be formed integrally in outer wall 26, at axially spaced positions, again with inner wall 28 constituting lid or cover 39. As shown in FIG. 10, inner wall 28 may have a plurality of longitudinally spaced circumferential folds or pleats 30 to enhance flexibility and upward movement of inner wall 28** during use. All of the forming and assembly techniques necessary to provide the above structures are techniques known to those having ordinary skill in the art.

While certain embodiments of the invention have been shown and described hereinabove, it is to be recognized and understood that changes and additions may be envisioned and made by those skilled in the art without departing from the scope and spirit of the invention.

What is claimed is:

1. An elongated tubular member sealed at a first end and at an intermediate location along its length, said tubular member having an outer portion defined by said first end and said intermediate location and having an inwardly folded flexible portion extending into said outer portion said tubular member having a second sealed end terminating short of said first end to provide a fluid tight inner chamber between said portions and a product receptable within said folded portion, a closure member being disposed adjacent said intermediate location enclosing said receptable, dispensing valve means being provided on said closure member for delivering a product from said receptacle in controlled amounts and pressures, pressure generating means being disposed in said inner chamber for progressively moving said second sealed end toward said intermediate location to gradually decrease the volume of said product containing receptacle, said pressure generating means comprising a first elongated strip and a second elongated strip at least partially coextensive therewith and releasably secured thereto, said strips being disposed within said inner chamber and containing a plurality of pocket members at positions spaced from one another generally longitudinally relative to said portions, said second elongated strip being connected at at least one end to said folded flexible portion in a region adjacent said second sealed end, an end of said first strip adjacent said one end of said second strip being interconnected with said outer portion, said second strip being removable from said first strip as said second sealed end moves toward said intermediate location, thereby successively opening adjacent pocket members.

2. In the apparatus of claim 1, a first reactive component of a two component gas generating system disposed in said pocket members, and the second component disposed in said inner chamber externally of said pocket members.

3. In the apparatus of claim 2, one of said components being citric acid and the other of said components being sodium bicarbonate.

4. In the apparatus of claim 1, said outer portion being relatively inflexible and said folded portion being relatively flexible.

5. In the apparatus of claim 4, said pressure generating means including a starting capsule disposed in said inner chamber, said capsule containing an aliquot of said first component and being adapted to release said first component into contact with said second component to initiate the generation of said gaseous pressure.

6. In the apparatus of claim 5, said capsule being frangible upon application of manual force.

7. In the apparatus of claim 5, said capsule comprised of material that is degradable in said second component.

8. The apparatus of claim 1 which include, a product to be dispensed disposed in said container.

9. In the apparatus of claim 1, said pocket members having progressively larger volume in sequence from the first pocket member opened to the last pocket member in the series.

10. An elongated tubular member sealed at a first end and at an intermediate location along its length, said tubular member having an outer portion defined by said first end and said intermediate point and having an inwardly folded flexible portion extending into said outer portion, said tubular member further having a second sealed end terminating short of said first end to provide a fluid tight inner chamber between said portions and a product receptacle within said folded portion, a closure member being disposed adjacent said intermediate location enclosing said receptacle, dispensing vlave means being disposed on said closure member for delivering a product from said receptacle in controlled amounts and pressures, pressure generating means being disposed in said inner chamber for progressively moving said second sealed end toward said intermediate location to gradually decrease the volume of said receptacle, said pressure generating means comprising a plurality of pocket members integrally formed within said outer portion at positions longitudinally spaced from each other, said folded flexible portion releasably closing said pocket members, whereby adjacent pocket members are successively opened as said second sealed end moves toward said intermediate location.

11. In the apparatus of claim 10, said pocket members having progressively larger volume in sequence from the first pocket member opened to the last pocket member in the series.

* * * * *